US008127408B2

(12) United States Patent
Wiseman

(10) Patent No.: US 8,127,408 B2
(45) Date of Patent: Mar. 6, 2012

(54) MAGNETICALLY CONNECTED SOCKET JOINT STRUCTURES, AND ITEMS COMPRISING THE MAGNETICALLY CONNECTED SOCKET JOINT STRUCTURES

(75) Inventor: Zachary D. Wiseman, Washington, DC (US)

(73) Assignee: Zachary D. Wiseman, Laurel, MD (US)

( * ) Notice: Subject to any disclaimer, the term of this patent is extended or adjusted under 35 U.S.C. 154(b) by 1121 days.

(21) Appl. No.: 11/583,712

(22) Filed: Oct. 20, 2006

(65) Prior Publication Data

US 2007/0180858 A1 Aug. 9, 2007

Related U.S. Application Data

(63) Continuation-in-part of application No. 10/807,118, filed on Mar. 24, 2004, now abandoned.

(51) Int. Cl.
*A44B 99/00* (2010.01)
*A44C 5/02* (2006.01)

(52) U.S. Cl. ..... 24/303; 63/3.1; 63/900; 59/85

(58) Field of Classification Search ..... None
See application file for complete search history.

(56) References Cited

U.S. PATENT DOCUMENTS 1,198,227 A * 9/1916 Hinchey ..... 292/251.5
(Continued)

*Primary Examiner* — Jack W. Lavinder
(74) *Attorney, Agent, or Firm* — McKenna Long & Aldridge LLP

(57) ABSTRACT

Magnetically connected socket joint components comprise one or more paired components so as to form socket joint structures which can form various different articles, such as, for example, articles of jewelry, toys, educational implements, games or amusement devices, instructional aids, eyeglass frames, robotic arms, prosthetic devices, human replacement joints, and the like. The socket joint structures comprise convexly configured male and concavely configured female socket components which may be fabricated from suitable magnetic materials, or alternatively, the convexly configured male socket components may be fabricated from suitable magnetic materials while the concavely configured female socket components may be fabricated from suitable ferromagnetic materials, or vice versa.

17 Claims, 7 Drawing Sheets

U.S. PATENT DOCUMENTS 2,496,691 A * 2/1950 Berry ..... 292/251.5
2,970,388 A * 2/1961 Yonkers ..... 434/277
6,427,486 B1 8/2002 Yellen
6,626,727 B2 9/2003 Balanchi

* cited by examiner

MAGNETICALLY CONNECTED SOCKET JOINT STRUCTURES, AND ITEMS COMPRISING THE MAGNETICALLY CONNECTED SOCKET JOINT STRUCTURES

CROSS REFERENCE TO RELATED PATENT APPLICATIONS

This patent application is a Continuation-in-Part (CIP) patent application of U.S. patent application Ser. No. 10/807,118 which was filed on Mar. 24, 2004 now abandoned in the name of Zachary D. Wiseman and which is entitled ITEMS MAGNETICALLY CONNECTED THROUGH UNIVERSAL JOINTS, the disclosure of which is hereby incorporated herein by reference.

FIELD OF THE INVENTION

The present invention relates generally to magnetically connected socket joint structures, and more particularly to new and improved magnetically connected socket joint components which can be easily and readily assembled or joined together, and subsequently disassembled, as desired, as one or more paired components, so as to form magnetically connected socket joint structures which can, in turn, form, or be utilized within, various different articles, items, devices, or implements, such as, for example, articles of jewelry, toys, educational implements, games or amusement devices, instructional aids, eyeglass frames, robotic arms, prosthetic devices, human replacement joints, and the like.

BACKGROUND OF THE INVENTION

Magnetic components have of course been used for a considerably long period of time in conjunction with the fabrication, manufacture, or implementation of various different articles, toys, games, amusement devices, educational implements, instructional aids, and the like, and accordingly, the incorporation of such magnetic components into such articles, toys, games, amusement devices, educational implements, instructional aids, and the like, has resulted in the inherent demonstration or exhibition of well-known magnetic principles and properties which people invariably or alternatively find fascinating, amusing, entertaining, educational, and instructional. An example of a magnetic construction toy is disclosed within U.S. Pat. No. 6,626,727 which issued to Balanchi on Sep. 30, 2003. Recently, magnetic components have been utilized in conjunction with the fabrication and marketing of therapeutic devices, and still further, magnetic components have also been utilized in connection with the fabrication of various different jewelry devices. Examples of such jewelry devices or items can be found within U.S. Pat. No. 6,427,486 which issued to Yellen on Aug. 6, 2002, United States Patent Application Publication No. 2004/0126621 which was published in the name of Fukuda on Jul. 1, 2004, and Japanese Patent Publication 11-103915 which was published in the name of Sakurai on Apr. 20, 1999. All of the devices or articles disclosed within the aforenoted patent publications utilize magnetic components which are magnetically connected to each other either along external point-to-point contact loci, or alternatively, along external line-to-line contact loci. While the magnetic connections established or defined between adjacent ones of the magnetic components, along the aforenoted point-to-point contact loci, or along the aforenoted line-to-line contact loci, are sufficiently strong or secure for certain applications or uses, when such magnetic components are adapted to be utilized in connection with alternative applications or uses, it is desirable to enhance the effective strength of the magnetic connections so as to, for example, ensure that the magnetically connected components do not become separated, or alternatively, that the magnetically connected components can be moved to, and maintain, different angular positions or orientations with respect to each other.

A need therefore exists in the art for new and improved magnetic components which can be easily and readily assembled or joined together as one or more paired components, and which can likewise be easily and readily disassembled with respect to each other, and yet the magnetically connected components will exhibit enhanced magnetic attractive forces so as to be useful within a variety of diverse applications, such as, for example, articles of jewelry, toys, educational implements, games or amusement devices, instructional aids, eyeglass frames, robotic arms, prosthetic devices, human replacement joints, and the like.

SUMMARY OF THE INVENTION

The foregoing and other objectives are achieved in accordance with the teachings and principles of the present invention through the provision of new and improved magnetic components which comprise magnetically connected socket joint components. The magnetically connected socket joint components comprise a first spherically configured component which effectively defines a first convexly configured male socket joint component, and a second spherically configured component which has spherically configured socket recesses formed within diametrically opposite sides thereof so as to effectively define a second concavely configured female socket joint component which is adapted to be magnetically connected to the first convexly configured male socket joint component. In accordance with a first embodiment of the present invention, the first convexly configured male socket joint component is fabricated from a suitable magnetic material, while the second concavely configured female socket joint component is fabricated from a suitable ferromagnetic material. In addition, since the arcuate contours of the spherically configured recesses of the second concavely configured female socket component are defined by means radii, as considered in all three of the mutually orthogonal directions X,Y,Z, which effectively match the radius of the first convexly configured male socket joint component, the first convexly configured male socket joint component will be disposed in surface-to-surface universal movement contact with the second concavely configured female socket joint component whereby the magnetic attraction, established or defined between the first convexly configured male socket joint component and the second concavely configured female socket joint component, is substantially enhanced as compared to the magnetic attraction established or defined between adjacent magnetically attracted components which are only disposed in point-to-point or line-to-line contact with respect to each other.

In accordance with a first modified alternative embodiment of the present invention, the first convexly configured male socket joint component may be fabricated from a suitable ferromagnetic material, while the second concavely configured female socket joint component may be fabricated from a suitable magnetic material, and furthermore, in accordance with a second modified alternative embodiment of the present invention, both of the first convexly configured male and second concavely configured female socket joint components may be fabricated from a suitable magnetic material. Still further, in accordance with other embodiments of the present invention, the first convexly configured male and second concavely configured female socket joint components may have the same or different diametrical extents, and in addition, the second, concavely configured female socket joint component may be provided with multiple pairs of diametrically opposite pairs of spherically configured recesses. Still yet further, in lieu of the one or more diametrically opposite pairs of spherically configured recesses, the second, concavely configured female socket joint component may be provided with an annular recess or socket. In a similar manner, in lieu of the second concavely configured female socket joint component comprising a spherical component, the second concavely configured female socket joint component may actually comprise a cylindrically configured component which has the aforenoted spherically configured recesses defined therein so as to nevertheless permit the first convexly configured male socket joint components to movably articulate in a universal manner with respect to such second concavely configured female socket joint component. Alternatively, the second concavely configured female socket joint component may be fabricated from a passive material having ferromagnetic cup, or annular or circumferential, members secured within the spherical, or annular or circumferential, recessed regions, or alternatively still further, the second concavely configured female socket joint component may be fabricated from a suitable passive metal material wherein the diametrical extent defined between the diametrically opposed spherical recesses, or between the diametrically opposed sides of the annular or circumferential recess, is small enough that a pair of the first, convexly configured male socket joint components can, in effect, be magnetically attracted and connected to each other so as to effectively entrap the second, concavely configured female passive metal socket joint component therebetween. This embodiment has particular utility, for example, in connection with the formation of various jewelry items.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 12 is a perspective view, similar to that of FIG. 1, showing, however, an eleventh modified embodiment of a new and improved article, device, item, or the like, wherein, in accordance with the principles and teachings of the present invention, a single first convexly configured male socket joint component is disposed within a single second concavely configured female socket joint component so as to form a single socket joint structure which may be utilized within, for example, eyeglass frames, a robotic arm, a human replacement joint, and the like.

DETAILED DESCRIPTION OF THE PREFERRED EMBODIMENT

Figure 1:
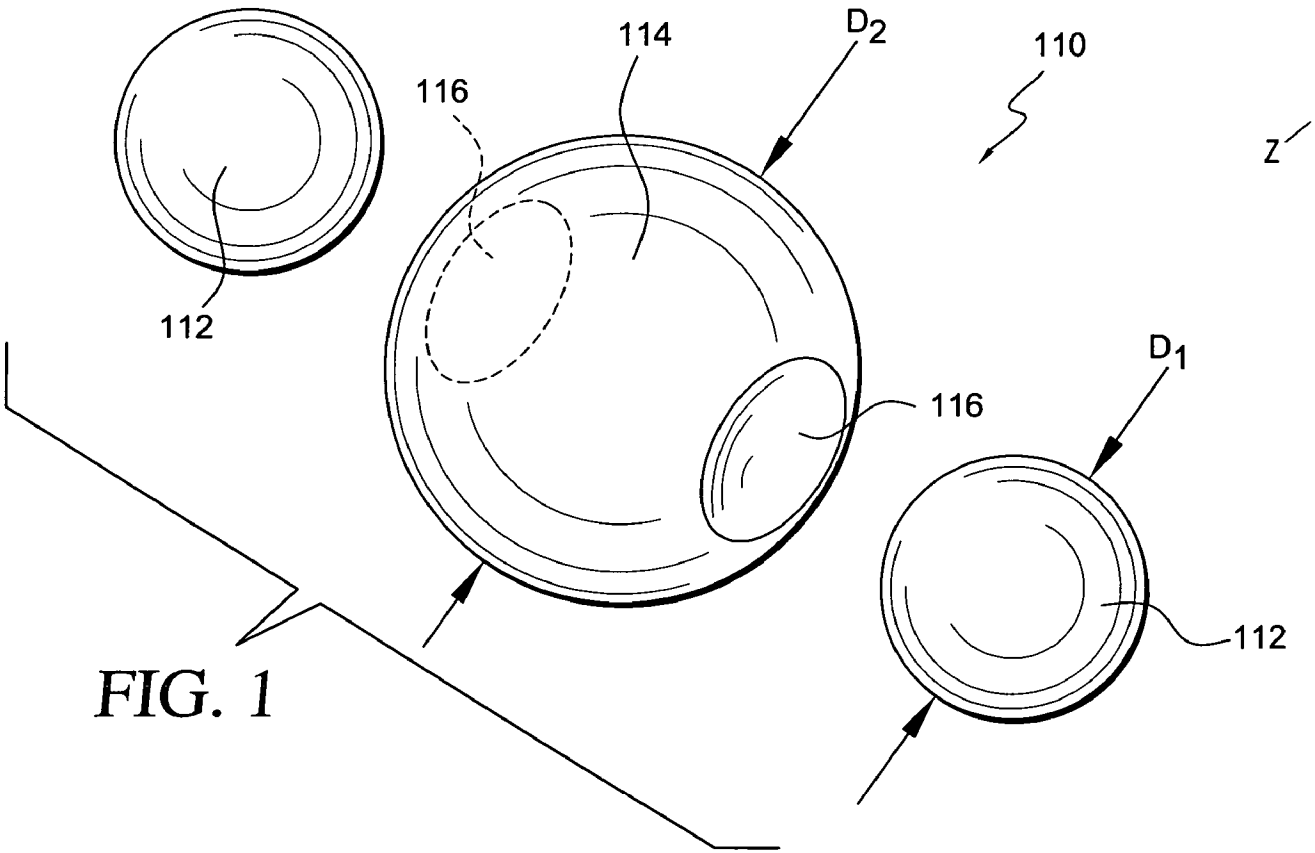
FIG. 1 is a partial perspective view of a first embodiment of a new and improved article, device, item, or the like, which has been fabricated and formed in accordance with the principles and teachings of the present invention wherein the article, device, item, or like comprises a plurality of first convexly configured male socket joint components which may be fabricated from a suitable magnetic material, and a plurality of second concavely configured female socket joint components, which may be fabricated from a suitable ferromagnetic material, are provided with a pair of diametrically opposed spherically configured recesses so as to accommodate the plurality of first convexly configured male socket joint components and define therewith magnetic socket joints which will permit the plurality of first convexly configured male socket joint components and the plurality of second concavely configured female socket joint components to be assembled together along surface-to-surface contact loci and to articulate with respect to each other in a universal manner with respect to three mutually orthogonal axes X,Y,Z.

Referring now to the drawings, and more particularly to FIG. 1 thereof, a first embodiment of a new and improved article, item, device, implement, or structure, which has been constructed, fabricated, or formed in accordance with the principles and teachings of the present invention, is disclosed and is generally indicated by the reference character 110. While the particular article, item, device, implement, or structure may comprise, for example, an article of jewelry, a toy, an educational implement, a game or amusement device, an instructional aid, an eyeglass frame, a robotic arm, a prosthetic device, a human replacement joint or the like, the initial discussion of the present invention will be directed toward an article of jewelry. More particularly, in accordance with the principles and teachings of the present invention, it is seen that, for example, the article of jewelry 110 is adapted to be, for example, a bracelet, necklace, or the like, similar to, for example, the necklace or bracelet as disclosed within the aforenoted U.S. patent application Ser. No. 10/807,118, the complete disclosure of which is hereby incorporated herein by reference. The necklace or bracelet 110 comprises a plurality of first, substantially spherically configured male socket joint components 112 which may be fabricated from a suitable magnetic material, such as, for example, a neodymium-iron-boron composition, which is subsequently magnetized, and a plurality of second, substantially spherically configured female socket joint components 114 which may be fabricated from a suitable ferromagnetic material such as, for example, stainless steel 440-C. It is noted that only one of the plurality of second, substantially spherically configured female socket joint components 114 is actually illustrated, however, in accordance with the principles and teachings of the present invention, the plurality of second, substantially spherically configured female socket joint components 114 are respectively adapted to be interposed between successive ones of the first, substantially spherically configured male socket joint components 112 in an alternating manner so as to complete the entire endless loop jewelry bracelet, necklace, or the like.

Figure 2:
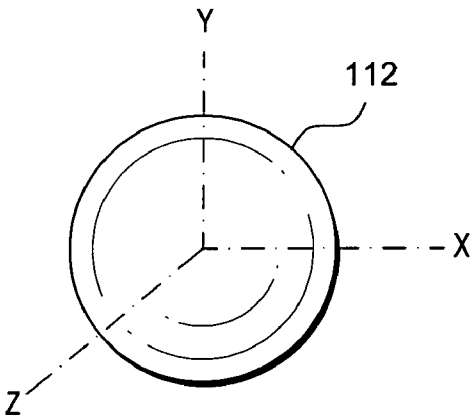
FIG. 2 is a diagram schematically illustrating how, for example, the first convexly configured male socket joint components can undergo universal movement with respect to the plurality of second concavely configured female, socket joint components as considered with respect to the three mutually orthogonal axes X,Y,Z.

In light of the fact that each one of the plurality of first spherically configured male socket joint components 112 has a substantially spherical configuration, and in light of the additional fact that each one of the plurality of first spherically configured male socket joint components 112 is fabricated from a suitable magnetic material, then opposite ends of each one of the plurality of first spherically configured male socket joint components 112 define opposite magnetic poles. In addition, each one of the plurality of second spherically configured female socket joint components 114 has a pair of diametrically opposed substantially spherically configured recesses 116 defined within outer peripheral portions thereof. Each one of the plurality of first spherically configured male socket joint components 112 has a predetermined radial or diametrical extent, and it is to be appreciated that each one of the pair of diametrically opposed recesses 116 defined within each one of the plurality of second spherically configured female socket joint components 114 has a predetermined, particularly defined arcuate or spherical configuration or contour, as considered in all three mutually orthogonal directions X,Y,Z as schematically illustrated in FIG. 2 in connection with one of the plurality of first spherically configured male socket joint components 112, that is likewise formed or defined by substantially the same radial or diametrical extent as that of each one of the plurality of first, spherically configured male socket joint components 112.

In this manner, the recesses 116 effectively define concavely configured female sockets which will permit any one of the plurality of first spherically or convexly configured male socket joint components 112 to move within the arcuately contoured recessed or socketed regions 116 of a particular one of the plurality of second concavely configured female socket joint components 114 in accordance with a substantially surface-to-surface contact mode of operation or movement. Alternatively, such interrelated structure permits a particular one of the plurality of second concavely configured female socket joint components 114 to likewise move, in a universal manner with respect to any one of the plurality of first convexly configured male socket joint components 112, in accordance with a substantially surface-to-surface contact mode of operation or movement.

Figure 3:
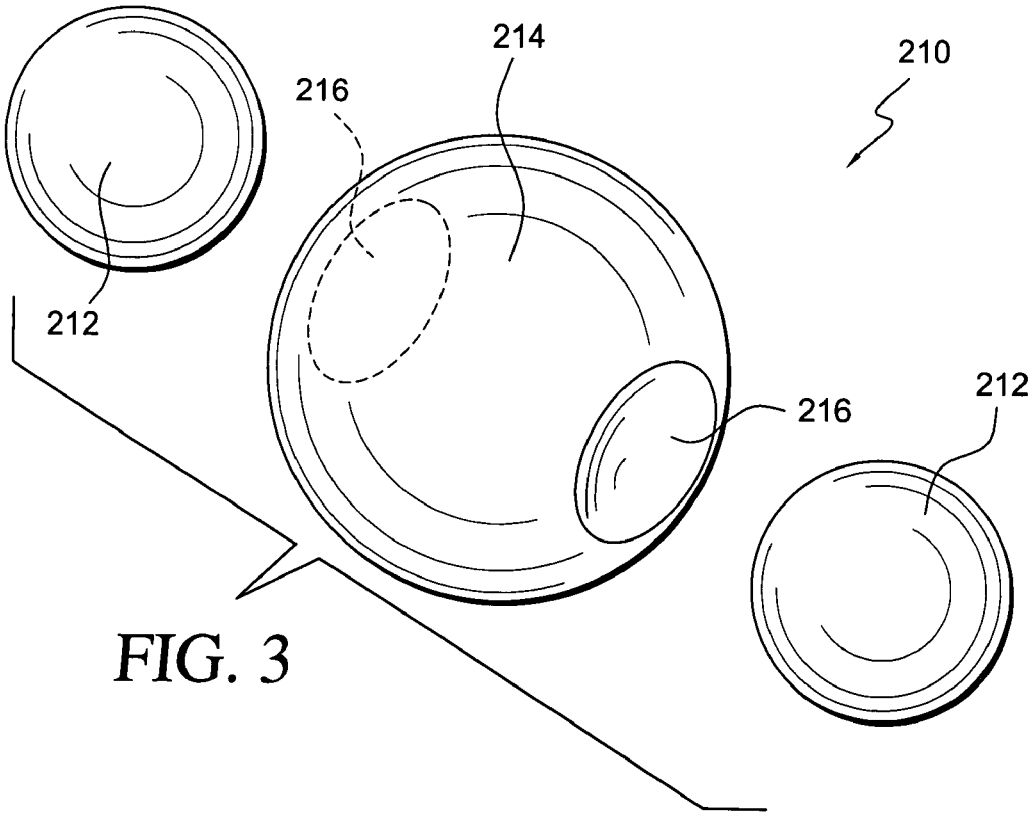
FIG. 3 is a partial perspective view, similar to that of FIG. 1, showing, however, a first modified embodiment of the new and improved article, device, item, or the like, wherein, in accordance with the principles and teachings of the present invention, the plurality of first convexly configured male socket joint components may be fabricated from a suitable ferromagnetic material while the plurality of second concavely configured female socket joint components may be fabricated from a suitable magnetic material.

With reference now being made to FIG. 3, a first modified embodiment of the new and improved article, device, item, implement, or structure, similar to but different from the new and improved article, device, item, implement, or structure 110 as disclosed within FIG. 1, is disclosed and is generally indicated by the reference character 210. It is noted that since the first modified embodiment of the new and improved article, device, item, implement, or structure 210 is substantially similar to the new and improved article, item, device, implement, or structure 110 as disclosed within FIG. 1, except as will be noted hereinafter, those socket components of the first modified embodiment of the new and improved article, device, item, implement, or structure 210, which correspond to the socket components of the first embodiment of the new and improved article, device, item, implement, or structure 110, as disclosed within FIG. 1, will be designated by corresponding reference characters except that they will be within the 200 series. More particularly, in accordance with additional alternative principles and teachings of the present invention, the plurality of first convexly configured male socket joint components 212 may be fabricated from a suitable ferromagnetic material, as has been disclosed hereinbefore, while the plurality of second concavely configured female socket joint components 214 may be fabricated from a suitable magnetic material as has also been disclosed hereinbefore.

Figure 4:
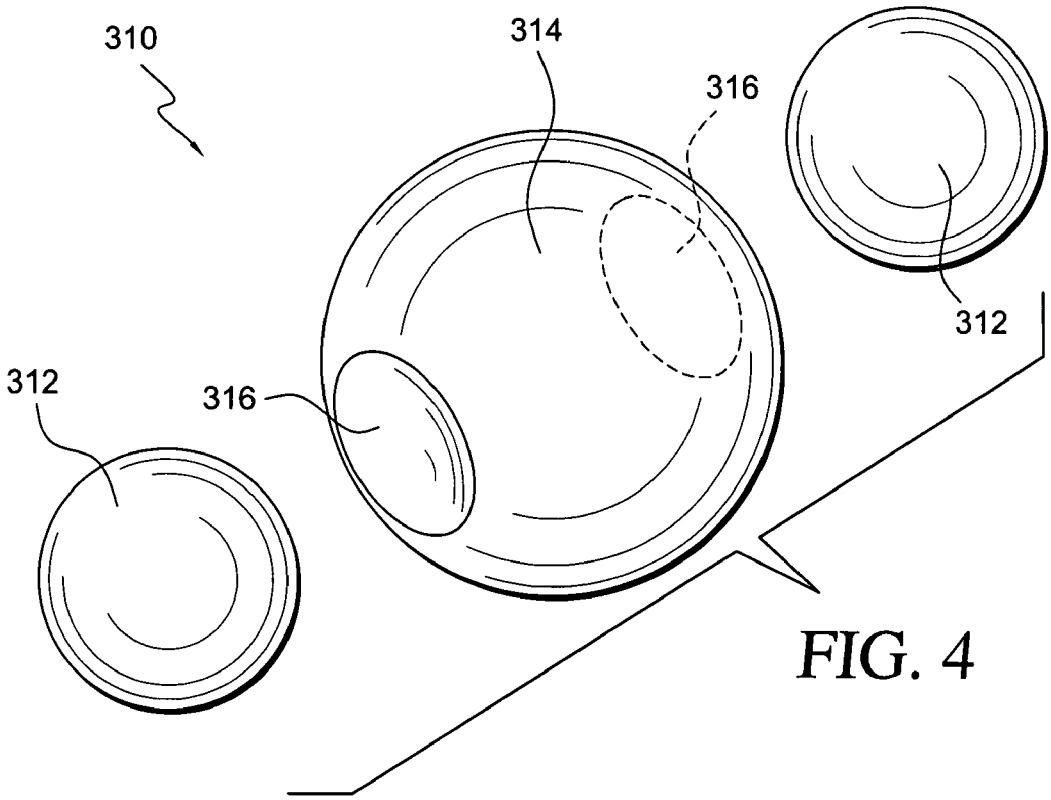
FIG. 4 is a partial perspective view, similar to that of either one of FIG. 1 or FIG. 3, showing, however, a second modified embodiment of the new and improved article, device, item, or the like, wherein, in accordance with the principles and teachings of the present invention, both the plurality of first convexly configured male socket joint components and the plurality of second concavely configured female socket joint components may be fabricated from a suitable magnetic material.

In a similar manner, and with reference now being made to FIG. 4, a second modified embodiment of the new and improved article, device, item, implement, or structure, constructed in accordance with the principles and teachings of the present invention, is disclosed and is generally indicated by the reference character 310. Again, it is noted that the second modified embodiment of the new and improved article, device, item, implement, or structure 310 is substantially similar to, but different from, the new and improved article, device, item, implement, or structure 110 as disclosed within FIG. 1, and is also substantially similar to the first modified embodiment of the new and improved article, device, item, implement, or structure 210 as disclosed within FIG. 3, except as will be noted hereinafter. Accordingly, those socket components of the second modified embodiment of the new and improved article, device, item, implement, or structure 310, which correspond to the socket components of the new and improved article, device, item, implement, or structure 110 as disclosed within FIG. 1, or to the socket components of the first modified embodiment of the new and improved article, device, item, implement, or structure 210 as disclosed within FIG. 3, will be designated by corresponding reference characters except that they will be within the 300 series. More particularly, in accordance with still additional alternative principles and teachings of the present invention, the plurality of first convexly configured male socket joint components 312 and the plurality of second concavely configured female socket joint components 314 may both be fabricated from a suitable magnetic material.

Figure 5:
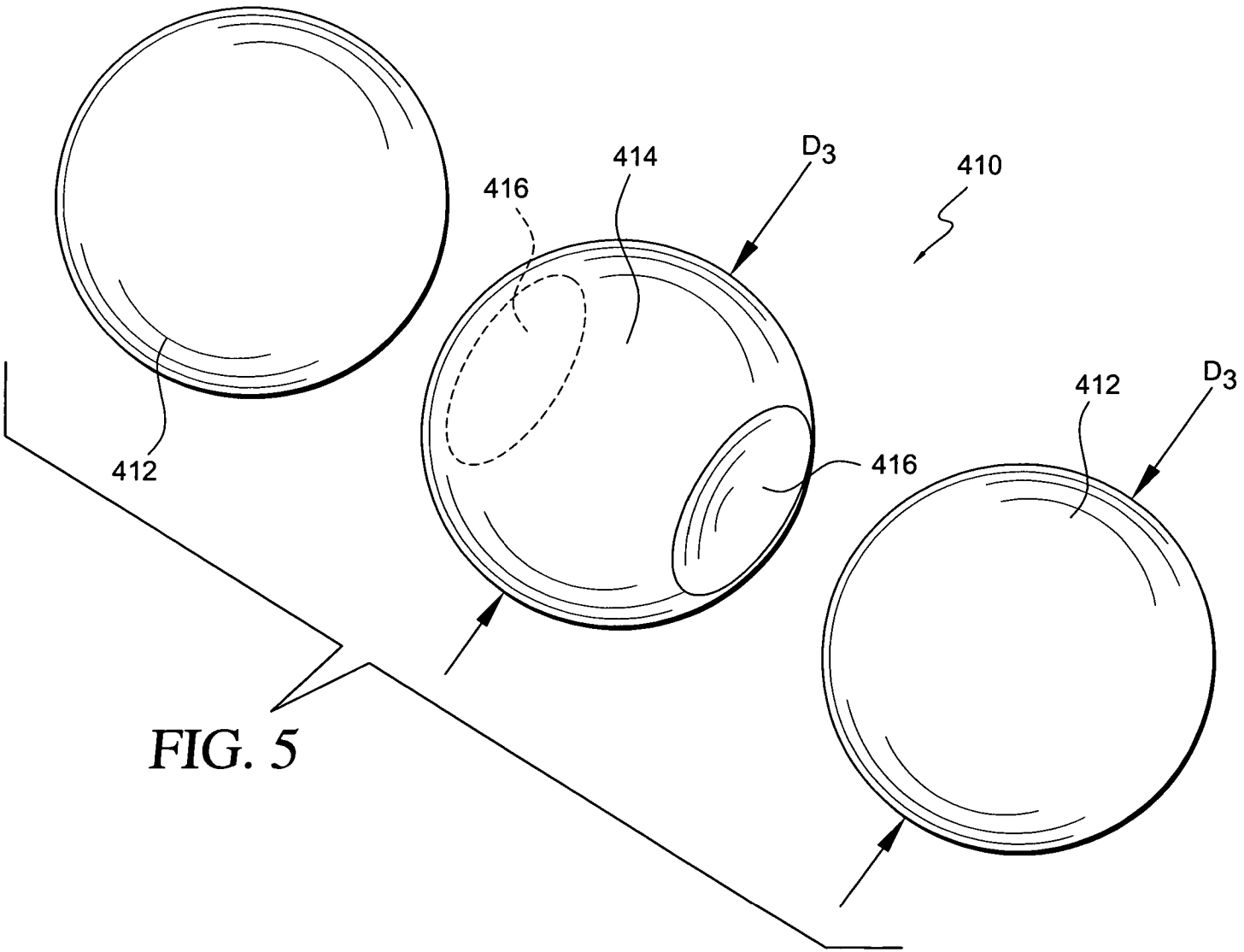
FIG. 5 is a partial perspective view, similar to that of either one of FIG. 1,3, or 4, showing, however, a third modified embodiment of the new and improved article, device, item, or the like, wherein, in accordance with the principles and teachings of the present invention, both the plurality of first convexly configured male socket joint components and the plurality of second concavely configured female socket joint components may have the same diametrical extent.

Continuing further, and with reference being made to FIG. 5, a third modified embodiment of the new and improved article, device, item, implement, or structure, similar to but different from the new and improved article, device, item, implement, or structure 110 as disclosed within FIG. 1, is disclosed and is generally indicated by the reference character 410. In view of the fact that the third modified embodiment of the new and improved article, device, item, implement, or structure 410 is substantially similar to the new and improved article, item, device, implement, or structure 110 as disclosed within FIG. 1, except as will be noted hereinafter, the socket components of the third modified embodiment of the new and improved article, device, item, implement, or structure 410, which correspond to those socket components of the first embodiment of the new and improved article, device, item, implement, or structure 110, as disclosed within FIG. 1, will be designated by corresponding reference characters except that they will be within the 400 series.

More particularly, it is noted that each one of the plurality of first convexly configured male socket joint components 112 comprising the first embodiment of the new and improved article, device, item, implement, or structure 110, as disclosed within FIG. 1, has a diametrical extent $D_1$, while each one of the plurality of second concavely configured female socket joint components 114 comprising the first embodiment of the new and improved article, device, item, implement, or structure 110, as disclosed within FIG. 1, has a diametrical extent $D_2$, wherein the diametrical extent $D_2$ of each one of the plurality of second concavely configured female socket joint components 114 is slightly larger than the diametrical extent $D_1$ of each one of the plurality of first convexly configured male socket joint components 112. Alternatively, each one of the plurality of first convexly configured male socket joint components 112 comprising the first embodiment of the new and improved article, device, item, implement, or structure 110, as disclosed within FIG. 1, may have a diametrical extent $D_1$ which is slightly larger than the diametrical extent $D_2$ of each one of the plurality of second concavely configured female socket joint components 114 comprising the first embodiment of the new and improved article, device, item, implement, or structure 110. To the contrary, or alternatively still further, in accordance with additional alternative principles and teachings of the present invention, each one of the plurality of first convexly configured male socket joint components 412 and each one of the plurality of second concavely configured female socket joint components 414 has the same diametrical extent $D_3$, it being noted however, or nevertheless, that the spherically configured recesses 416 are appropriately formed within the outer peripheral surface portions of each one of the plurality of second concavely configured female socket joint components 414 so as to have the same matching spherical profile as that of each one of the first convexly configured male socket joint components 412.

Figure 6:
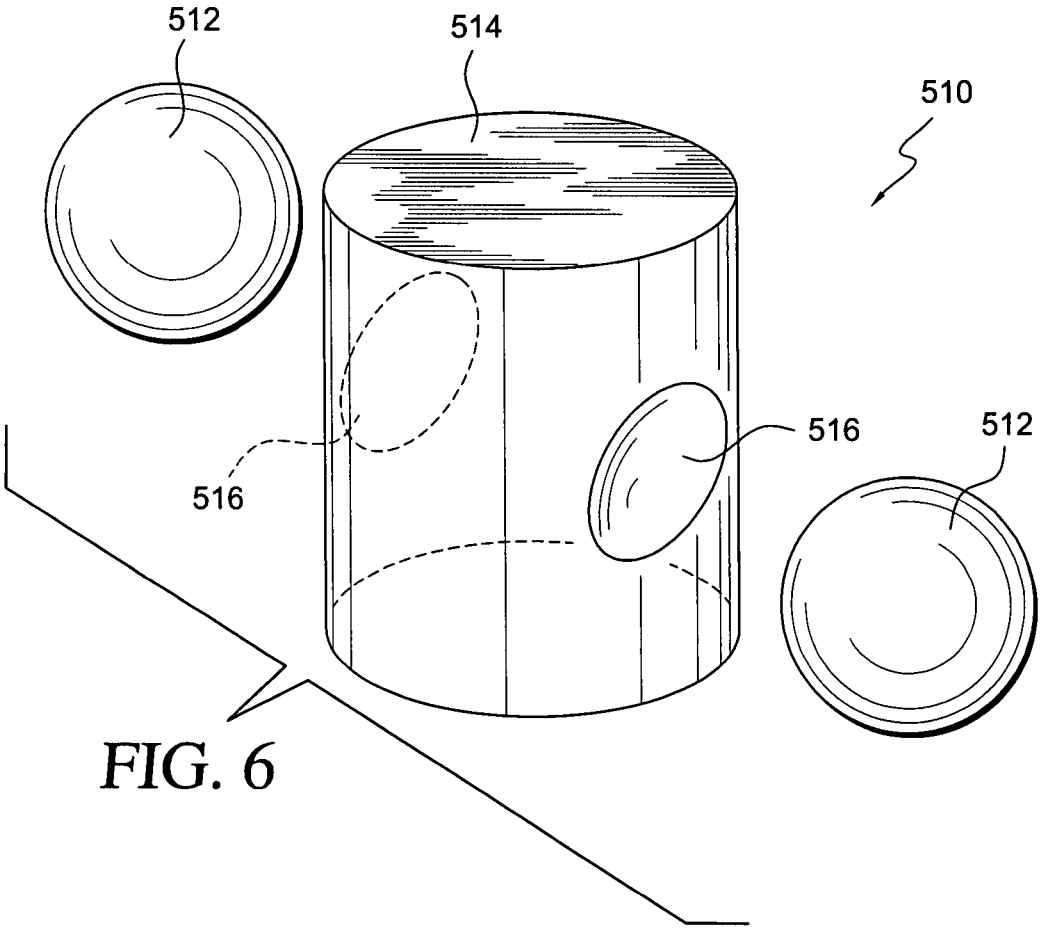
FIG. 6 is a partial perspective view, similar to that of either one of FIG. 1,3,4, or 5, showing, however, a fourth modified embodiment of the new and improved article, item, device, or the like, wherein, in accordance with the principles and teachings of the present invention, in lieu of the plurality of second concavely configured female socket joint components originally comprising spherically configured components, the plurality of second concavely configured female socket joint components may originally comprise cylindrically configured components.

Continuing still further, and with reference being made to FIG. 6, a fourth modified embodiment of the new and improved article, device, item, implement, or structure, similar to but different from the new and improved article, device, item, implement, or structure 110 as disclosed within FIG. 1, is disclosed and is generally indicated by the reference character 510. In view of the fact that the fourth modified embodiment of the new and improved article, device, item, implement, or structure 510 is substantially similar to the new and improved article, item, device, implement, or structure 110 as disclosed within FIG. 1, except as will be noted hereinafter, the socket components of the fourth modified embodiment of the new and improved article, device, item, implement, or structure 510, which correspond to the socket components of the first embodiment of the new and improved article, device, item, implement, or structure 110, as disclosed within FIG. 1, will be designated by corresponding reference characters except that they will be within the 500 series.

More particularly, as has been noted hereinbefore, each one of the plurality of first convexly configured male socket joint components 112, and each one of the plurality of second concavely configured female socket joint com-ponents 114, comprising the first embodiment of the new and improved article, device, item, implement, or structure 110, as disclosed within FIG. 1, comprise spherically configured socket components, however, in accordance with additional alternative principles and teachings of the present invention, each one of the plurality of second concavely configured female socket joint components 514 may be fabricated from a cylindrically configured structural component which nevertheless is also provided with the pair of diametrically opposed recesses 516 within the outer peripheral surface portions thereof and at the axially central region thereof. Still yet further, it is also to be appreciated that each one of the plurality of second concavely configured female socket joint components 514 may have other solid geometrical configurations.

Figure 7:
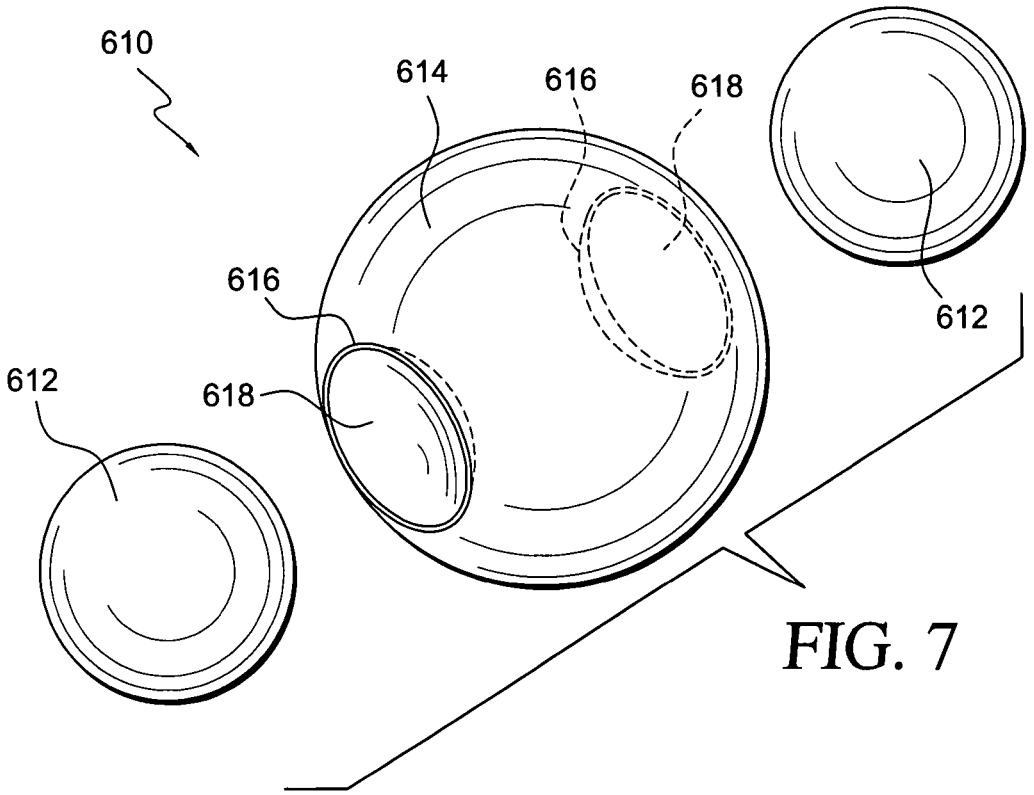
FIG. 7 is a partial perspective view, similar to that of either one of FIG. 1 or 3-5, showing, however, a fifth modified embodiment of a new and improved article, device, item, or the like, wherein, in accordance with the principles and teachings of the present invention, in lieu of the plurality of second concavely configured female socket joint components being fabricated from a suitable ferromagnetic material, the plurality of second concavely configured female socket joint components can be fabricated from a suitable passive material and spherically configured cup-type ferromagnetic inserts can be incorporated within the pair of diametrically opposed spherically recesses.

With reference now being made to FIG. 7, a fifth modified embodiment of the new and improved article, device, item, implement, or structure, similar to but different from the new and improved article, device, item, implement, or structure 110, as disclosed within FIG. 1, is disclosed and is generally indicated by the reference character 610. It is again noted that since the fifth modified embodiment of the new and improved article, device, item, implement, or structure 610 is substantially similar to the new and improved article, item, device, implement, or structure 110, as disclosed within FIG. 1, except as will be noted hereinafter, the socket components of the fifth modified embodiment of the new and improved article, device, item, implement, or structure 610, which correspond to the socket components of the first embodiment of the new and improved article, device, item, implement, or structure 110, as disclosed within FIG. 1, will be designated by corresponding reference characters except that they will be within the 600 series. More particularly, as has been noted hereinbefore in connection with the first embodiment of the new and improved article, device, item, implement, or structure 110 as disclosed within FIG. 1, each one of the plurality of first convexly configured male socket joint components 112 may be fabricated from a suitable magnetic material, and each one of the plurality of second concavely configured female socket joint components 114 may be fabricated from a suitable ferromagnetic material. However, in accordance with the teachings and principles comprising the fifth modified embodiment of the new and improved device, article, item, implement, or structure 610, in lieu of the plurality of second concavely configured female socket joint components 614 being fabricated from a suitable ferromagnetic material, the plurality of second concavely configured female socket joint components 614, having the pair of diametrically opposed recesses 616 defined within the outer peripheral surface portions thereof, may be fabricated from a suitable magnetically passive material, such as, for example, wood, glass, thermoplastic, or the like. In addition, a substantially spherically configured cup member or insert 618, fabricated from a suitable ferromagnetic material, is fixedly disposed within each one of the pair of diametrically opposed recesses 616 by means of any suitable process, such as, for example, a press fit, a shrink fit, an interference fit, an adhesive process, molding techniques, or the like, depending upon the particular material from which the plurality of second concavely configured female socket joint components 614 is fabricated. As can therefore be readily appreciated, the magnetic connections, defined between the plurality of first convexly configured male socket joint components 612 and the plurality of spherically configured cups or inserts 618 respectively mounted with the plurality of second concavely configured female socket joint components 614, can still be established.

Figure 8:
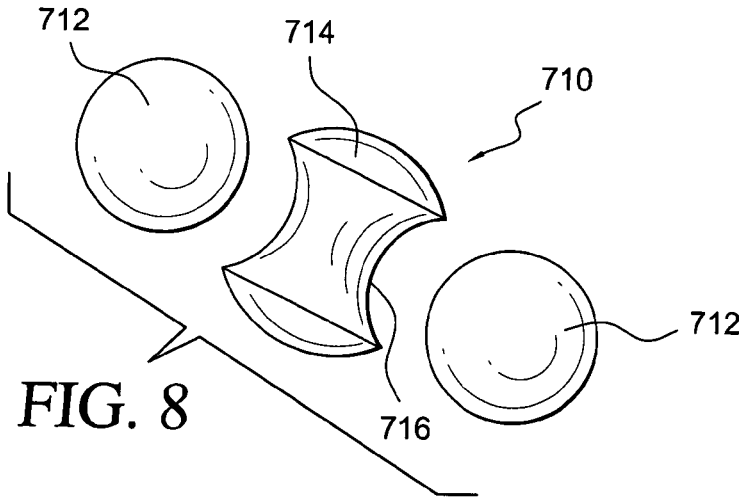
FIG. 8 is a partial perspective view, similar to that of either one of FIG. 1 or 3-5, showing, however, a sixth modified embodiment of a new and improved article, device, item, or the like, wherein, in accordance with the principles and teachings of the present invention, in lieu of the plurality of second concavely configured female socket joint components having the pair of diametrically opposed spherically configured recesses defined therein, the plurality of second concavely configured female socket joint components can be respectively provided with an annular or circumferentially extending recess.

Turning now to FIG. 8, a sixth modified embodiment of a new and improved article, device, item, implement, structure, or the like, similar to but different from the new and improved article, device, item, implement, or structure 110, as disclosed within FIG. 1, is disclosed and is generally indicated by the reference character 710. As was the case with the previous modified embodiments, since the sixth modified embodiment of the new and improved article, device, item, implement, or structure 710 is substantially similar to the new and improved article, item, device, implement, or structure 110, as disclosed within FIG. 1, except as will be noted hereinafter, the socket components of the sixth modified embodiment of the new and improved article, device, item, implement, or structure 710, which correspond to those socket components of the first embodiment of the new and improved article, device, item, implement, or structure 110, as disclosed within FIG. 1, will be designated by corresponding reference characters except that they will be within the 700 series.

More particularly, in lieu of each one of the plurality of second concavely configured female socket joint components 114 having the pair of diametrically opposite recessed portions 116, 116 defined within the side portions thereof, in accordance with further principles and teachings of the present invention, each one of the plurality of second concavely configured female socket joint components 714 may be provided with an annular or circumferential recess 716 within the axially central region thereof. The arcuate contours of the annular or circumferential recess 716 would, again, effectively match the spherical contours of the plurality of first convexly configured male socket joint components 712 so as to preserve the universal movement of the plurality of first and second convexly configured and concavely configured male and female socket joint components with respect to each other. In addition to such universal movements, it is also to be appreciated that the plurality of first convexly configured male socket joint components 712, disposed within the annular or circumferential recess 716, can effectively move in a circumferential manner, within the annular or circumferential recess 716, around its respective second concavely configured female socket joint component 714.

Figure 8A:
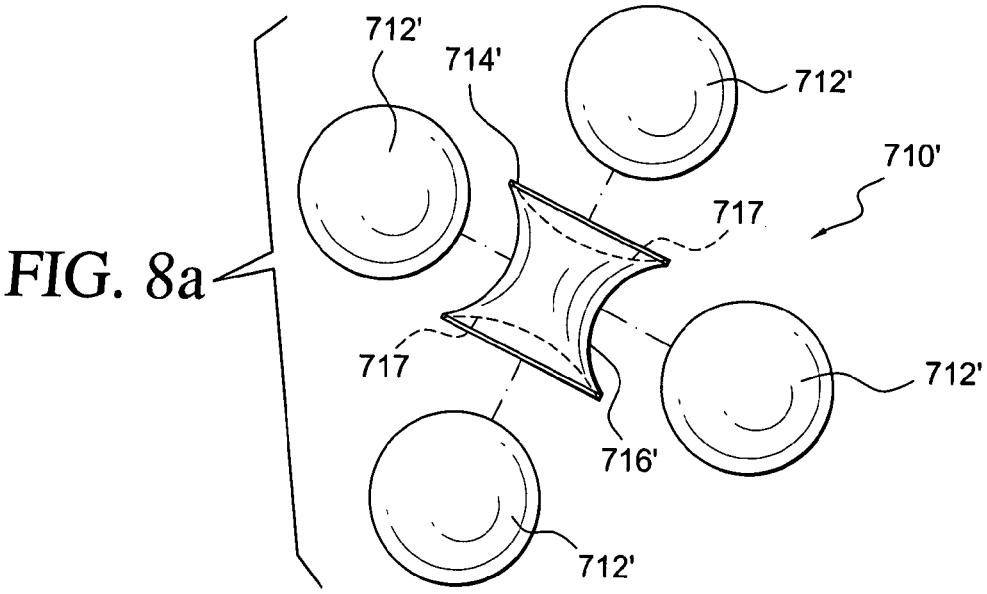
FIG. 8*a* is a partial perspective view, similar to that of FIG. 8, showing, however, a seventh modified embodiment of a new and improved article, device, item, or the like, wherein, in accordance with the principles and teachings of the present invention, each one of the plurality of second concavely configured female socket joint components can be respectively provided with an annular or circumferentially extending recess, and still further, a pair of diametrically opposed substantially spherically configured recesses for accommodating a plurality of the first convexly configured male socket joint components.

Considering now FIG. 8*a*, a seventh modified embodiment of a new and improved article, device, item, implement, structure, or the like, similar to but different from the new and improved article, device, item, implement, or structure 710, as disclosed within FIG. 8, is disclosed and is generally indicated by the reference character 710'. As was the case with the previous modified embodiments, since the seventh modified embodiment of the new and improved article, device, item, implement, or structure 710' is substantially similar to the new and improved article, item, device, implement, or structure 710, as disclosed within FIG. 8, except as will be noted hereinafter, the socket components of the seventh modified embodiment of the new and improved article, device, item, implement, or structure 710', which correspond to those socket components of the sixth embodiment of the new and improved article, device, item, implement, or structure 710, as disclosed within FIG. 8, will be designated by corresponding reference characters except that they will be within the 700' series. More particularly, it can be appreciated that in accordance with further principles and teachings of the present invention, in addition to each one of the plurality of second concavely configured female socket joint components 714' having the annular or circumferential recess 716' defined therein, each one of the plurality of second concavely configured female socket joint components 714' is also provided with a pair of diametrically opposed, substantially spherically configured recessed portions 717, 717 defined within the end portions thereof for likewise accommodating additional first convexly configured male socket joint components 712',712'.

As has been noted hereinbefore, while the plurality of first convexly configured male socket joint components 712', 712', and the plurality of second concavely configured female socket joint components 714' may have various different predetermined diametrical extents, that is, some or all of the plurality of first convexly configured male socket joint components 712', 712' may be diametrically larger than the plurality of second concavely con-figured female socket joint components 714', or some or all of the plurality of first convexly configured male socket joint components 712', 712' may be diametrically smaller than the plurality of second concavely configured female socket joint components 714', or still further, some or all of the plurality of first convexly configured male socket joint components 712', 712' and the plurality of second concavely configured female socket joint components 714' may be of approximately the same diametrical extent, the universal and substantially surface-to-surface contact states or dispositions defined therebetween are to be substantially preserved. It is also noted that the plurality of first convexly configured male socket joint components 712', 712' and the plurality of second concavely configured female socket joint components 714' may be alternatively fabricated from magnetic or ferromagnetic materials, or both of the plurality of male and female socket joint components can be fabricated from a magnetic material.

Figure 9:
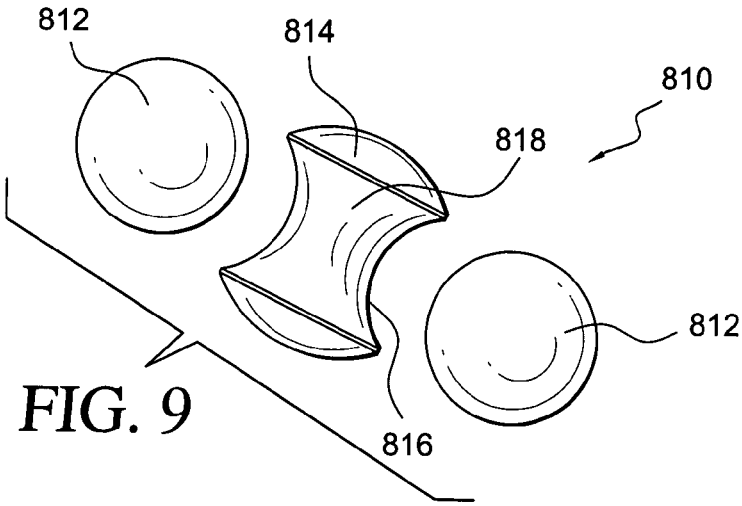
FIG. 9 is a partial perspective view, similar to that of either FIG. 8, showing, however, an eighth modified embodiment of a new and improved article, device, item, or the like, wherein, in accordance with the teachings and principles of the present invention, in lieu of the plurality of second concavely configured female socket joint components being fabricated from a suitable ferromagnetic material, the plurality of second concavely configured female socket joint components can be fabricated from a suitable passive material and annular or circumferentially extending ferromagnetic band members can be incorporated within the annular or circumferentially extending recesses.

With reference now being made to FIG. 9, an eighth modified embodiment of the new and improved article, device, item, implement, or structure, similar to but different from the sixth modified embodiment of the new and improved article, device, item, implement, or structure 710, as disclosed within FIG. 8, is disclosed and is generally indicated by the reference character 810. It is again noted that since the eighth modified embodiment of the new and improved article, device, item, implement, or structure 810 is substantially similar to the new and improved article, item, device, implement, or structure 710, as disclosed within FIG. 8, except as will be noted hereinafter, the socket components of the eighth modified embodiment of the new and improved article, device, item, implement, or structure 810, which correspond to the socket components of the sixth embodiment of the new and improved article, device, item, implement, or structure 110, as disclosed within FIG. 8, will be designated by corresponding reference characters except that they will be within the 800 series.

More particularly, as has been noted hereinbefore in connection with, for example, the first embodiment of the new and improved article, device, item, implement, or structure 110 as disclosed within FIG. 1, each one of the plurality of first convexly configured male socket joint components 112 may be fabricated from a suitable magnetic material, and each one of the plurality of second concavely configured female socket joint components 114 may be fabricated from a suitable ferromagnetic material, and such fabrication parameters would likewise apply to the new and improved article, device, item, implement, or structure 710 as disclosed within FIG. 8. However, in accordance with the teachings and principles comprising the eighth modified embodiment of the new and improved article, device, item, implement, or structure 810, in lieu of the plurality of second concavely configured female socket joint components 814 being fabricated from a suitable ferromagnetic material, the plurality of second concavely configured female socket joint components 814, having the annular or circumferential recesses 816 defined within the outer peripheral surface portions thereof, may be fabricated from a suitable magnetically passive material, such as, for example, wood, glass, thermoplastic, or the like. In addition, an annular or circumferential band member or insert 818, fabricated from a suitable ferromagnetic material, and matching the arcuate contours of the annular or circumferential recesses 816, is fixedly disposed within each one of the annular or circumferential recesses 816 by means of any suitable process, such as, for example, a press fit, a shrink fit, an interference fit, molding techniques, an adhesive process, or the like, depending upon the particular material from which the plurality of second concavely configured female socket joint components 814 is fabricated. As can therefore be readily appreciated, the magnetic connections, defined between the plurality of first convexly configured male socket joint components 812 and the plurality of annular or circumferential band members or inserts 818 respectively mounted within the plurality of second concavely configured female socket joint components 814, can still be established.

Figure 10:
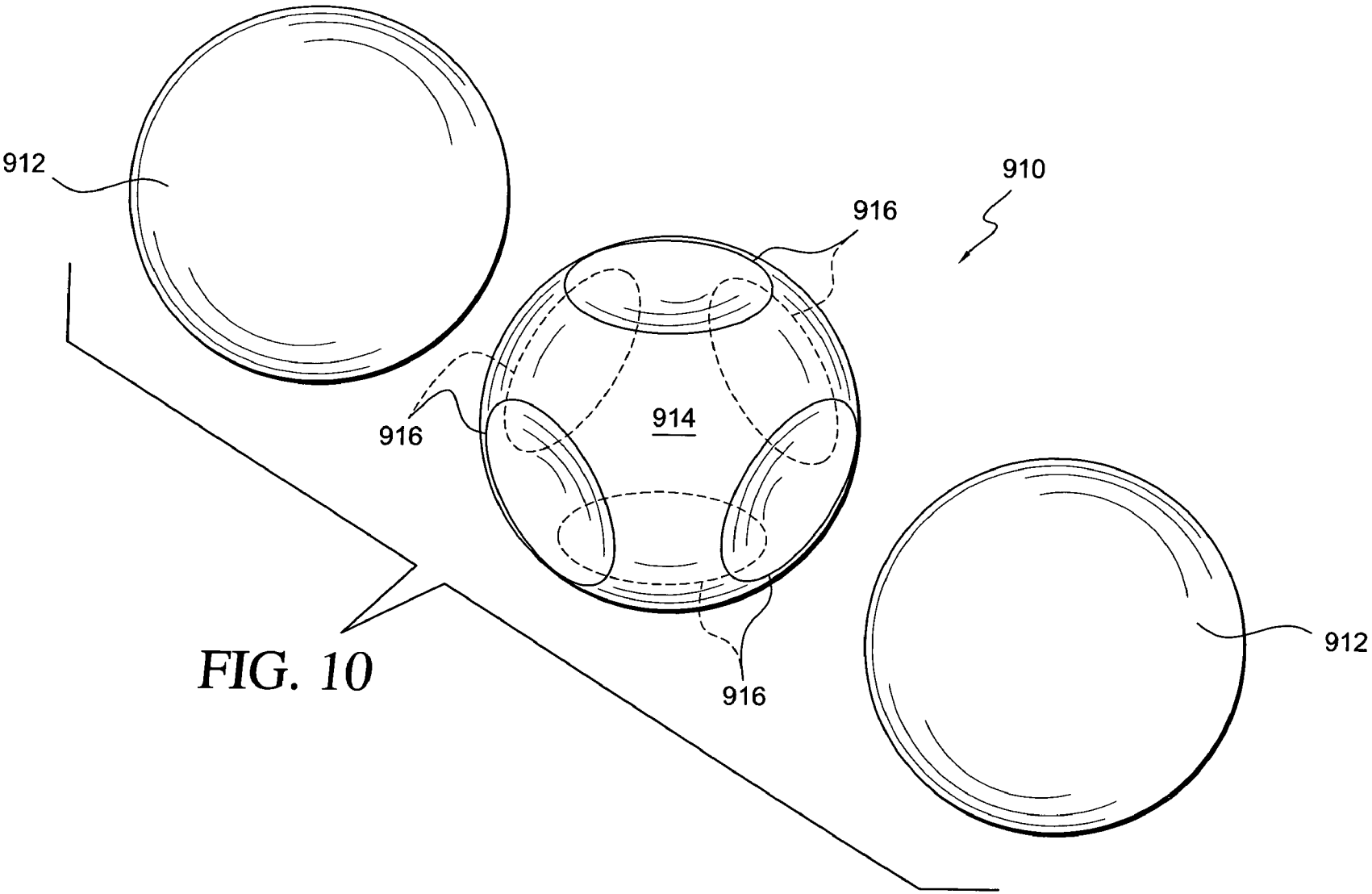
FIG. 10 is a partial perspective view, similar to that of either one of FIG. 1 or 3-5, showing, however, a ninth modified embodiment of a new and improved article, device, item, or the like, wherein, in accordance with the principles and teachings of the present invention, in lieu of the plurality of second concavely configured female socket joint components being provided with a single pair of diametrically opposed spherically configured recesses, the plurality of second concavely configured female socket joint components can be provided with multiple pairs of diametrically opposed spherically configured recesses.

With reference now being made to FIG. 10, a ninth modified embodiment of the new and improved article, device, item, implement, or structure, similar to but different from the new and improved article, device, item, implement, or structure 110 as disclosed within FIG. 1, is disclosed and is generally indicated by the reference character 910. It is noted that since the ninth modified embodiment of the new and improved article, device, item, implement, or structure 910 is substantially similar to the new and improved article, item, device, implement, or structure 110 as disclosed within FIG. 1, except as will be noted hereinafter, those socket components of the ninth modified embodiment of the new and improved article, device, item, implement, or structure 910, which correspond to the socket components of the first embodiment of the new and improved article, device, item, implement, or structure 110, as disclosed within FIG. 1, will be designated by corresponding reference characters except that they will be within the 900 series.

More particularly, in accordance with additional alternative principles and teachings of the present invention, while the plurality of second concavely configured female socket joint components 114 were provided with a single pair of diametrically opposed spherically configured recesses 116, 116, each one of the plurality of second concavely configured female socket joint components 914 are provided with multiple pairs of diametrically opposed recesses 916. In particular, each one of the plurality of second concavely configured female socket joint components 914 is provided with three pairs of diametrically opposed recesses 916 which are effectively aligned or oriented along the three mutually orthogonal axes X,Y,Z. The provision of such multiple pairs of diametrically opposite pairs of recesses 916,916 permits the plurality of first convexly configured male socket joint components 912 to be magnetically connected to plurality of second concavely configured female socket joint components 914 at different locations, and to be moved in different directions, as may be desired.

Figure 11:
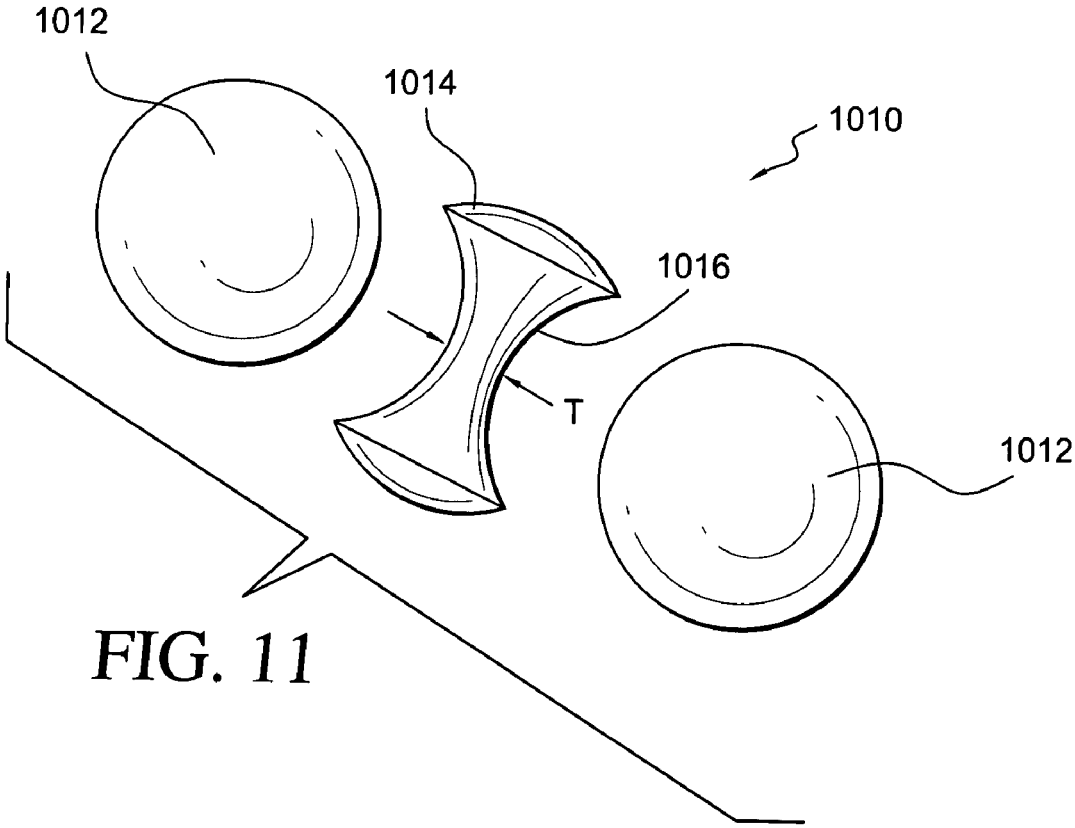
FIG. 11 is a partial perspective view, similar to that of either FIG. 1 or 3-9, showing, however, a tenth modified embodiment of a new and improved article, device, item, or the like, wherein, in accordance with the principles and teachings of the present invention, in lieu of the plurality of second, concavely configured female socket joint components being fabricated from a suitable ferromagnetic material, or having a suitable ferromagnetic material incorporated therein, the plurality of second, concavely configured female socket joint components can be fabricated from a suitable passive metal material wherein the diametrical extent or thickness dimension between, in effect, diametrically opposed spherically recesses, or diametrically opposed sides of the annular or circumferential recess, is sufficiently small that a pair of the first convexly configured magnetic male socket joint components can, in effect, be magnetically attracted and connected to each other so as to effectively entrap the second, concavely configured female, passive metal socket joint component therebetween.

Turning now to FIG. 11, a tenth modified embodiment of the new and improved article, device, item, implement, or structure, similar to but different from the new and improved article, device, item, implement, or structure 110 as disclosed within FIG. 1, is disclosed and is generally indicated by the reference character 1010. It is noted that since the tenth modified embodiment of the new and improved article, device, item, implement, or structure 1010 is substantially similar to the new and improved article, item, device, implement, or structure 110 as disclosed within FIG. 1, except as will be noted hereinafter, those socket components of the tenth modified embodiment of the new and improved article, device, item, implement, or structure 1010, which correspond to the socket components of the first embodiment of the new and improved article, device, item, implement, or structure 110, as disclosed within FIG. 1, will be designated by corresponding reference characters except that they will be within the 1000 series. More particularly, in accordance with additional principles and teachings of the present invention, in lieu of the plurality of second, concavely configured female socket joint components 1014 being fabricated from a suitable ferromagnetic material, or having a suitable ferromagnetic material incorporated therein, the plurality of second, concavely configured female socket joint components 1014 can be fabricated from a suitable passive metal material such as, for example, gold, silver, platinum, copper, and the like. In addition, it is noted that the thickness dimension T between, in effect, the diametrically opposed sides of the annular or circumferential recess, or between spherical recesses 1016, disposed upon opposite sides of each one of the plurality of second, concavely configured female socket joint components 1014, is sufficiently small such that when a pair of the first, convexly configured magnetic male socket joint components 1012, 1012 are disposed within the diametrically opposite sides of the annular or circumferential recess, or within the oppositely disposed spherical recesses 1016, the magnetic fields of the pair of first, convexly configured magnetic male socket joint components 1012, 1012 will, in effect, interact with each other such that the pair of first, convexly configured magnetic male socket joint components 1012, 1012 will be magnetically attracted and connected to each other so as to also effectively entrap the second, concavely configured female, passive metal socket joint component 1014 therebetween. This modified embodiment of a new and improved article, device, item, implement, structure 1010 has particular utility in connection with the formation of, for example, jewelry items or the like wherein the jewelry item 1010 may comprise a bracelet or necklace, and wherein, in particular, the plurality of second, concavely configured female, passive metal socket joint components 1014 may comprise, for example, pendants, charms, or the like.

Figure 12:
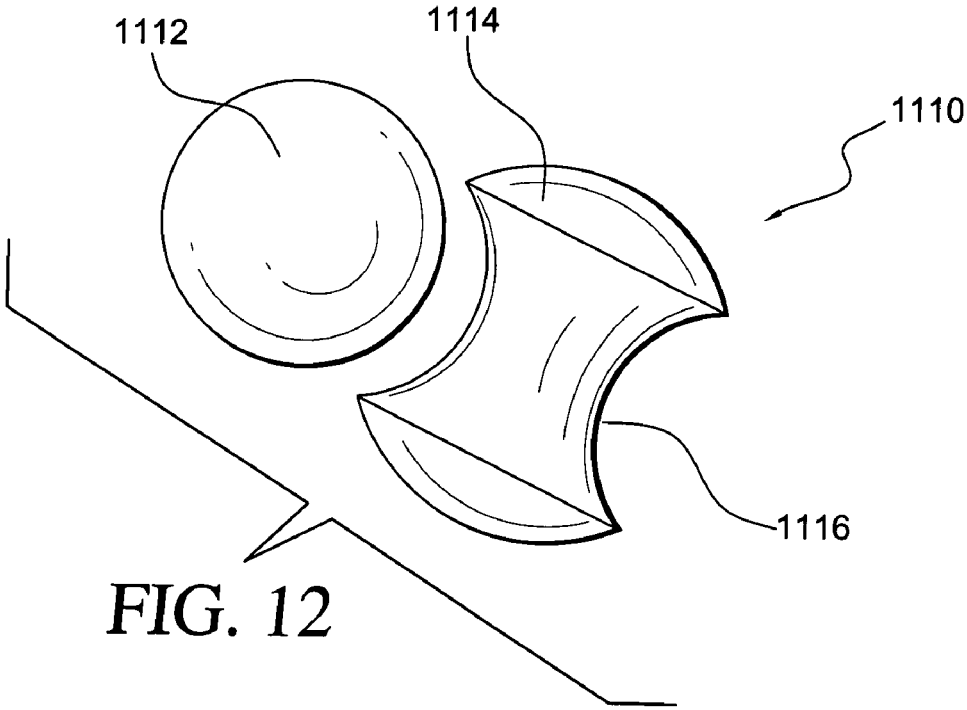

With reference lastly being made to FIG. 12, an eleventh modified embodiment of a new and improved article, device, item, implement, structure, or the like, similar to but different from the new and improved article, device, item, implement, or structure 110, as disclosed within FIG. 1, is disclosed and is generally indicated by the reference character 1110. As was the case with the previous modified embodiments, since the eleventh modified embodiment of the new and improved article, device, item, implement, or structure 1110 is substantially similar to the new and improved article, item, device, implement, or structure 110, as disclosed within FIG. 1, except as will be noted hereinafter, the socket components of the eleventh modified embodiment of the new and improved article, device, item, implement, or structure 1110, which correspond to the socket components of the first embodiment of the new and improved article, device, item, implement, or structure 110, as disclosed within FIG. 1, will be designated by corresponding reference characters except that they will be within the 1100 series. More particularly, in accordance with additional principles and teachings of the present invention, a single first convexly configured male socket joint component 1112 is disposed within a single second concavely configured female socket joint component 1114 so as to form the single socket joint structure 1110.

The single joint structure 1110 finds utility as an independent structural joint of the type that may be utilized within, for example, eyeglass frames wherein, for example, either the first convexly configured male socket joint component 1112 may be incorporated within the eyeglass frame member while the second concavely configured female socket joint component 1114 may be incorporated within the earpiece, or vice versa. In this manner, by magnetically connecting, for example, the socket joint earpiece component 1114 to the socket joint eyeglass frame member 1112, the conventional little screw fasteners, which normally or conventionally connect the eyeglass earpiece component to the eyeglass frame member, may effectively be eliminated. Another use for such single joint structure 1110 may reside, for example, within robotic arm assemblies. Again, the first convexly configured male socket joint component 1112 may be incorporated within the robotic frame member while the second concavely configured female socket joint component 1114 may be incorporated within the movable robotic arm. Still yet further, the single joint structure 1110 may also be used within a human replacement joint assembly, such as, for example, a hip joint assembly. The first convexly configured male socket joint component 1112 may be incorporated within the human femur, while the second concavely configured female socket joint component 1114 may be incorporated within the innominate bone portion of the pelvic structure. Similarly, the single joint structure 1110 can be used as an integral part of a prosthetic joint assembly. As was the case with the sixth embodiment 710 as disclosed within FIG. 8, in addition to the universal movements of the first convexly configured male socket joint component 1112 within the annular or circumferential recess 1116 of the second concavely configured female socket joint component 1114, it is also to be appreciated that the first convexly configured male socket joint components 1112, disposed within the annular or circumferential recess 1116, can effectively move in a circumferential manner, within the annular or circumferential recess 1116, around its respective second concavely configured female socket joint component 1114.

While it has been noted that the magnetic structures characteristic of the present invention may comprise, for example, any one of various different jewelry items, toys, games or amusement devices, educational implements, instructional aids, robotic arm assemblies, human replacement joint structures, and the like, it is to be appreciated that when the magnetic structure of the present invention is to comprise a jewelry item, such as, for example, a bracelet, necklace, or the like, each one of the first convexly configured male socket joint components, as well as each one of the second concavely configured female socket joint components may be provided with suitable decorative or protective coatings. More particularly, the decorative or protective coatings may be suitably colored. For example, each one of the first convexly configured male socket joint components may be gold-plated or colored, while each one of the second concavely configured female socket joint components may be silver-plated or colored. Of course, other protective coatings, decorative coating, and colors are possible, such as, for example, platinum, copper, chromium, rhodium, nickel, plastics, enamels, and the like. Of course, it is to also be understood that if the ferromagnetic components are fabricated, for example, from stainless steel, they may not need protective coatings although they may of course be provided with suitable decorative coatings. Still further, and again, when the articles, item, structures, or the like, comprise, for example, jewelry items, precious stones, semi-precious stones, and the like, may be integrally or fixedly incorporated within the various socket components.

Thus, it may be seen that in accordance with the principles and teachings of the present invention, there has been disclosed various embodiments of magnetically connected socket joint components which can be easily and readily assembled or joined together, and subsequently disassembled, as desired, and which can comprise one or more paired components, so as to form socket joint structures which can, in turn, form, or be utilized within, various different articles, items, devices, implements, structures, or the like, such as, for example, articles of jewelry, toys, educational implements, games or amusement devices, instructional aids, eyeglass frames, robotic arms, prosthetic devices, human replacement joints, and the like. The socket joint structures comprise convexly configured male and concavely configured female socket components which may be fabricated from suitable magnetic materials, or alternatively, the convexly configured male socket components may be fabricated from suitable magnetic materials while the concavely configured female socket components may be fabricated from suitable ferromagnetic materials, or vice versa.

Obviously, many variations and modifications of the present invention are possible in light of the above teachings. For example, while the aforenoted disclosure has emphasized the use of substantially spherically configured male and female socket joint components, it is possible to employ substantially cylindrically configured male and female socket joint components wherein the socket joint components will nevertheless be disposed in surface-to-surface magnetically connected operational contact modes. It is therefore to be understood that within the scope of the appended claims, the present invention may be practiced otherwise than as specifically described herein.

What is claimed as new and desired to be protected by Letters Patent of the United States of America, is:

1. A magnetically connected socket joint structure, comprising:

at least one convexly configured male socket joint component having a substantially spherical configuration; and at least one concavely configured female socket joint component comprising at least one pair of diametrically opposed substantially spherically configured recesses within which said at least one convexly configured substantially spherical male socket joint component is disposed and maintained as a result of said at least one convexly configured substantially spherical male socket joint component and said at least one concavely configured female socket joint component being magnetically connected together in a surface-to-surface contact mode so as to form said magnetically connected socket joint structure.

2. The magnetically connected socket joint structure as set forth in claim 1, wherein:

said at least one convexly configured male socket joint component is fabricated from a suitable magnetic material; and said at least one concavely configured female socket joint component is fabricated from a suitable ferromagnetic material.

3. The magnetically connected socket joint structure as set forth in claim 1, wherein:

said at least one convexly configured male socket joint component is fabricated from a suitable ferromagnetic material; and said at least one concavely configured female socket joint component is fabricated from a suitable magnetic material.

4. The magnetically connected socket joint structure as set forth in claim 1, wherein:

both said at least one convexly configured male socket joint component and said at least one concavely configured female socket joint component are fabricated from a suitable magnetic material.

5. The magnetically connected socket joint structure as set forth in claim 1, wherein:

said at least one pair of diametrically opposed substantially spherically configured recesses defined within said at least one concavely configured female socket joint component comprises multiple diametrically opposed pairs of said substantially spherically configured recesses.

6. The magnetically connected socket joint structure as set forth in claim 1, wherein:

said at least one recess defined within said at least one concavely configured female socket joint component comprises an arcuately configured annular recess within which said at least one convexly configured substantially spherical male socket joint component is accommodated.

7. The magnetically connected socket joint structure as set forth in claim 6, further comprising:

a pair of diametrically opposed substantially spherically configured recesses for accommodating additional convexly configured substantially spherical male socket joint components.

8. The magnetically connected socket joint structure as set forth in claim 1, wherein:

said at least one convexly configured male socket joint component is fabricated from a suitable magnetic material;

said at least one concavely configured female socket joint component is fabricated from a suitable magnetically passive material; and a ferromagnetic member is disposed within said at least one recess defined within said at least one concavely configured female socket joint component.

9. The magnetically connected socket joint structure as set forth in claim 1, wherein:

said at least one convexly configured male socket joint component comprises a plurality of convexly configured male socket joint components; and said at least one concavely configured female socket joint component comprises a plurality of concavely configured female socket joint components.

10. The magnetically connected socket joint structure as set forth in claim 9, wherein:

said plurality of convexly configured male socket joint components and said plurality of concavely configured female socket joint components are magnetically connected together in an alternating manner.

11. The magnetically connected socket joint structure as set forth in claim 9, wherein:

said plurality of convexly configured male socket joint components and said plurality of concavely configured female socket joint components comprise a jewelry item.

12. The magnetically connected socket joint structure as set forth in claim 1, wherein:

said at least one convexly configured male socket joint component comprises at least a pair of convexly configured male socket joint components fabricated from a suitable magnetic material; and said at least one concavely configured female socket joint component is fabricated from a magnetically passive material and has recess means defined within oppositely disposed surface portions thereof so as to accommodate said pair of convexly configured magnetic male socket joint components, wherein the thickness dimension of said oppositely disposed surface portions is sufficiently small so as to permit said pair of convexly configured magnetic male socket joint components to be magnetically connected together thereby entrapping said at least one concavely configured female socket joint component therebetween.

13. The magnetically connected socket joint structure as set forth in claim 12, wherein:

said pair of convexly configured male socket joint components and said at least one concavely configured female socket joint component entrapped between said pair of convexly configured male socket joint components comprises a jewelry item.

14. The magnetically connected socket joint structure as set forth in claim 13, wherein:

said at least one concavely configured female socket joint component, entrapped between said pair of convexly configured male socket joint components, is selected from the group comprising a jewelry pendant and a jewelry charm.

15. The magnetically connected socket joint structure as set forth in claim 1, wherein:

said at least one convexly configured male socket joint component and said at least one concavely configured female socket joint component comprise socket joint components of an eyeglass frame assembly.

16. The magnetically connected socket joint structure as set forth in claim 1, wherein:

said at least one convexly configured male socket joint component and said at least one concavely configured female socket joint component comprise socket joint components of a prosthetic limb assembly.

17. The magnetically connected socket joint structure as set forth in claim 1, wherein:

said at least one convexly configured male socket joint component and said at least one concavely configured female socket joint component comprise socket joint components of a human replacement joint assembly.

* * * * *